US008215687B2

(12) United States Patent
Pietras et al.

(10) Patent No.: US 8,215,687 B2
(45) Date of Patent: Jul. 10, 2012

(54) REMOTELY OPERATED SINGLE JOINT ELEVATOR

(75) Inventors: Bernd-Georg Pietras, Wedemark (DE); Kevin Wood, Langenhagen (DE); Karsten Heidecke, Houston, TX (US); John D. Hooker, II, Langenhagen (DE); Martin Helms, Burgdorf (DE); Martin Liess, Seeize (DE)

(73) Assignee: Weatherford/Lamb, Inc., Houston, TX (US)

( * ) Notice: Subject to any disclaimer, the term of this patent is extended or adjusted under 35 U.S.C. 154(b) by 826 days.

(21) Appl. No.: 12/258,357

(22) Filed: Oct. 24, 2008

(65) Prior Publication Data

US 2009/0110535 A1 Apr. 30, 2009

Related U.S. Application Data

(60) Provisional application No. 60/983,129, filed on Oct. 26, 2007.

(51) Int. Cl.
*E21B 19/06* (2006.01)
*B25B 5/08* (2006.01)

(52) U.S. Cl. ..... 294/203; 294/116; 294/194

(58) Field of Classification Search ..... 294/90, 294/102.2, 194, 201, 203, 116, 102.1
See application file for complete search history.

(56) References Cited

U.S. PATENT DOCUMENTS

| | | | | |
|---|---|---|---|---|
| 1,452,127 | A | 4/1923 | Sitzman | |
| 3,937,515 | A * | 2/1976 | Langowski | 294/197 |
| 4,126,348 | A * | 11/1978 | Palmer | 294/194 |
| 4,441,749 | A * | 4/1984 | Blaschke et al. | 294/194 |
| 4,647,099 | A * | 3/1987 | Berry et al. | 294/103.1 |
| 4,765,401 | A | 8/1988 | Boyadjieff | |
| 4,811,635 | A * | 3/1989 | Falgout, Sr. | 81/57.33 |
| 5,340,182 | A * | 8/1994 | Busink et al. | 294/199 |
| 5,702,139 | A * | 12/1997 | Buck | 294/198 |
| 6,138,529 | A * | 10/2000 | Pietras | 81/57.33 |
| 6,270,136 | B1 * | 8/2001 | Dagenais | 294/207 |
| 2006/0191689 | A1 | 8/2006 | Severin et al. | |
| 2008/0277108 | A1 | 11/2008 | Bouligny et al. | |

FOREIGN PATENT DOCUMENTS

EP 0 589 823 A1 3/1994

OTHER PUBLICATIONS

Australian Office Action for Application No. 2008315508 dated Sep. 2, 2011.

Canadian Application No. 2,702,809 Office Action (Nov. 15, 2011).

PCT/IB2008/054415 International Search Report (Nov. 7, 2011).

* cited by examiner

*Primary Examiner* — Dean Kramer

(74) *Attorney, Agent, or Firm* — Patterson & Sheridan, L.L.P.

(57) ABSTRACT

A remotely operated joint elevator for use in handling a tubular is provided. The single joint elevator including a housing having an access opening configured to receive the tubular. The single joint elevator further including at least one closure member connected to the housing via a hinge pin. Additionally, the single joint elevator including a power assembly configured to rotate at least one closure member around the hinge pin to selectively open and close the access opening. In another aspect, a method of handling a tubular using a remotely operated joint elevator is provided. In yet a further aspect, a remotely operated joint elevator for use in handling a tubular.

13 Claims, 21 Drawing Sheets

REMOTELY OPERATED SINGLE JOINT ELEVATOR

CROSS-REFERENCE TO RELATED APPLICATIONS

This application claims benefit of U.S. provisional patent application Ser. No. 60/983,129, filed Oct. 26, 2007, which is herein incorporated by reference.

BACKGROUND OF THE INVENTION

1. Field of the Invention

Embodiments of the invention generally relate to apparatus and methods for handling tubulars. More particularly, embodiments of the invention relate to a remotely operated joint elevator.

2. Description of the Related Art

When drilling wells in the oil and gas industry using a drilling rig, the operation of hoisting tubulars onto the rig floor is commonly accomplished by using an elevator suspended within the derrick of the rig. Usually the elevator is sized and constructed to be suitable only for handling single tubular joints (i.e. not a string of joints connected together). Such an elevator is referred to as a "single joint elevator" or "SJE". Single joint elevators are typically opened and closed manually.

There are several problems associated with the use of manually operated single joint elevators. One problem is that a single joint elevator sized for large diameter tubulars (such as 16" or above) would be necessarily large itself and manual operation would become onerous and cumbersome. Another problem is that there are occasions during the tubular hoisting process when the single joint elevator must be opened or closed, but is out of reach of the personnel on the rig. In such circumstances a crew member is usually attached to a winch, and is physically lifted and suspended adjacent the elevator in order to operate it. Clearly this is a hazardous situation. A further problem is that manual operation of equipment (even when within reach) presents safety hazards, such as trapping fingers or the inadvertent release of a tubular from the elevator. Therefore there is a need for a remotely-operated elevator, particularly one suitable for handling large diameter tubulars.

SUMMARY OF THE INVENTION

The present invention generally relates to apparatus and methods for gripping tubulars. In one aspect, a remotely operated single joint elevator for use in handling a tubular is provided. The single joint elevator including a housing having an access opening configured to receive the tubular. The single joint elevator further including at least one closure member connected to the housing via a hinge pin. Additionally, the single joint elevator including a power assembly configured to rotate at least one closure member around the hinge pin to selectively open and close the access opening.

In another aspect, a method of handling a tubular using a remotely operated single joint elevator is provided. The method including the step of positioning the single joint elevator proximate the tubular, wherein the single joint elevator includes an access opening. The method further including the step of activating a power assembly in the single joint elevator to selectively expose the access opening. Further, the method including the step of receiving the tubular in the single joint elevator via the access opening. Additionally, the method including the step of activating the power assembly in the single joint elevator to selectively close the access opening.

In yet a further aspect, a remotely operated single joint elevator for use in handling a tubular. The single joint elevator including a housing having an access opening configured to receive the tubular. The single joint elevator including a power assembly configured to selectively open and close the access opening. Additionally, the single joint elevator including a locking assembly configured to lock the power assembly upon indication that the tubular is in the single joint elevator and the access opening is closed.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to apparatus and methods for handling tubulars using a remotely operated single joint elevator. It should be noted that even though the invention will be described in relation to a single joint elevator, the aspects of the invention may equally be applied to string elevators that handle multiple tubular joints connected in a string of tublars. To better understand the aspects of the present invention and the methods of use thereof, reference is hereafter made to the accompanying drawings.

FIGS. 1-4 are views that illustrate a remotely operated single joint elevator 100 as the single joint elevator 100 interacts with a tubular 90. The operation of the single joint elevator 100 will be described generally as it relates to the single joint elevator 100 of FIGS. 5-8. However, it should be noted that the operation equally applies to other embodiments described herein.

Figure 1:
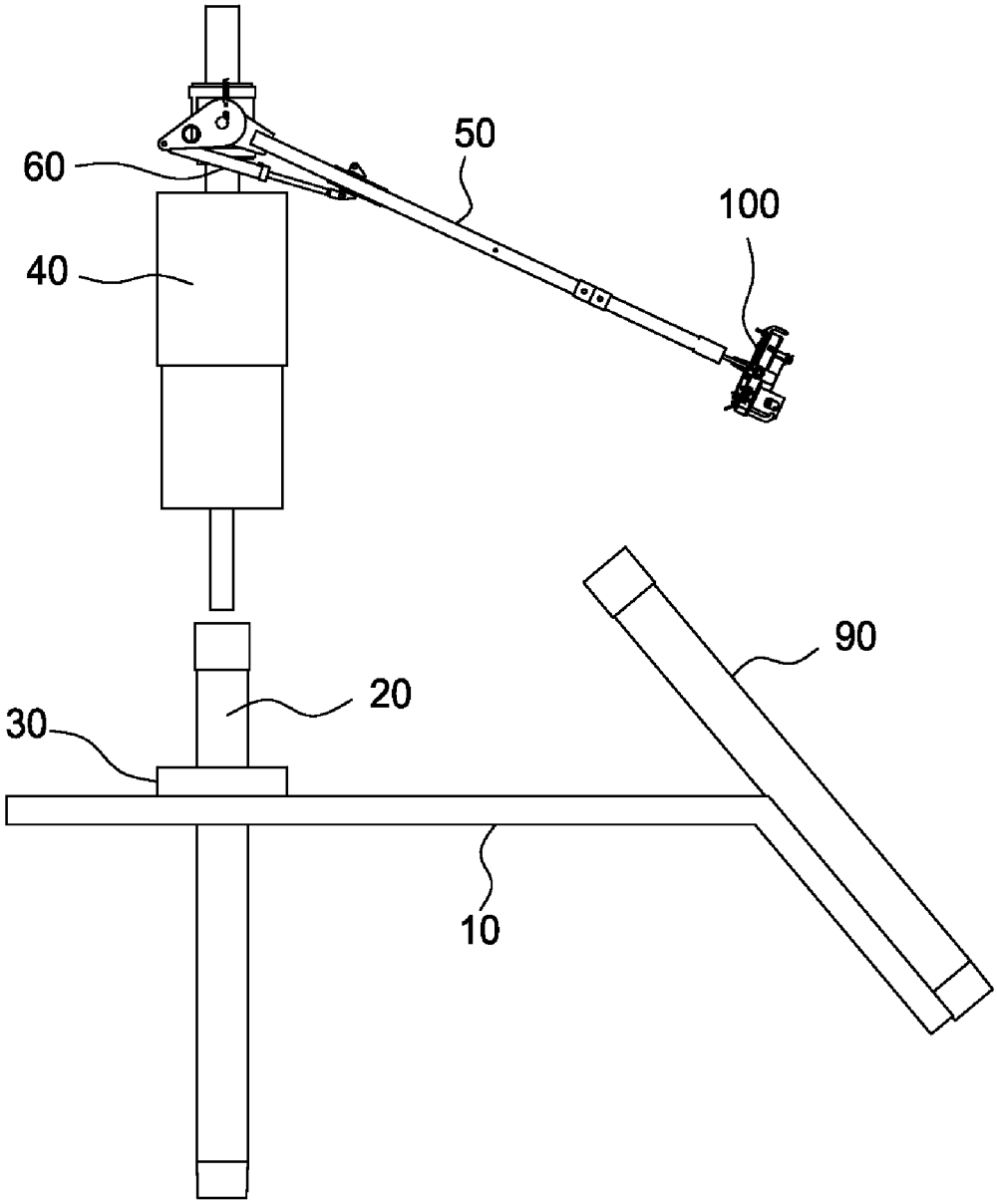
FIG. 1 is a view illustrating a remotely operated single joint elevator according to one embodiment of the invention. The single joint elevator is attached to a running unit.

As shown in FIG. 1, a tubular string 20 is supported at a rig floor 10 by a spider 30. As also shown, a running unit 40 is positioned proximate the tubular string 20. Typically, the running unit 40 is attached to a Top Drive (not shown). A pair of handling bails 50 is pivotally attached to the running unit 40. Hydraulic cylinders 60 are fixed between the running unit 40 and the bails 50. By operating the hydraulic cylinders 60, the bails 50 can be raised or lowered accordingly. An end of the bails 50 are attached to the remotely operated single joint elevator 100.

Figure 2:
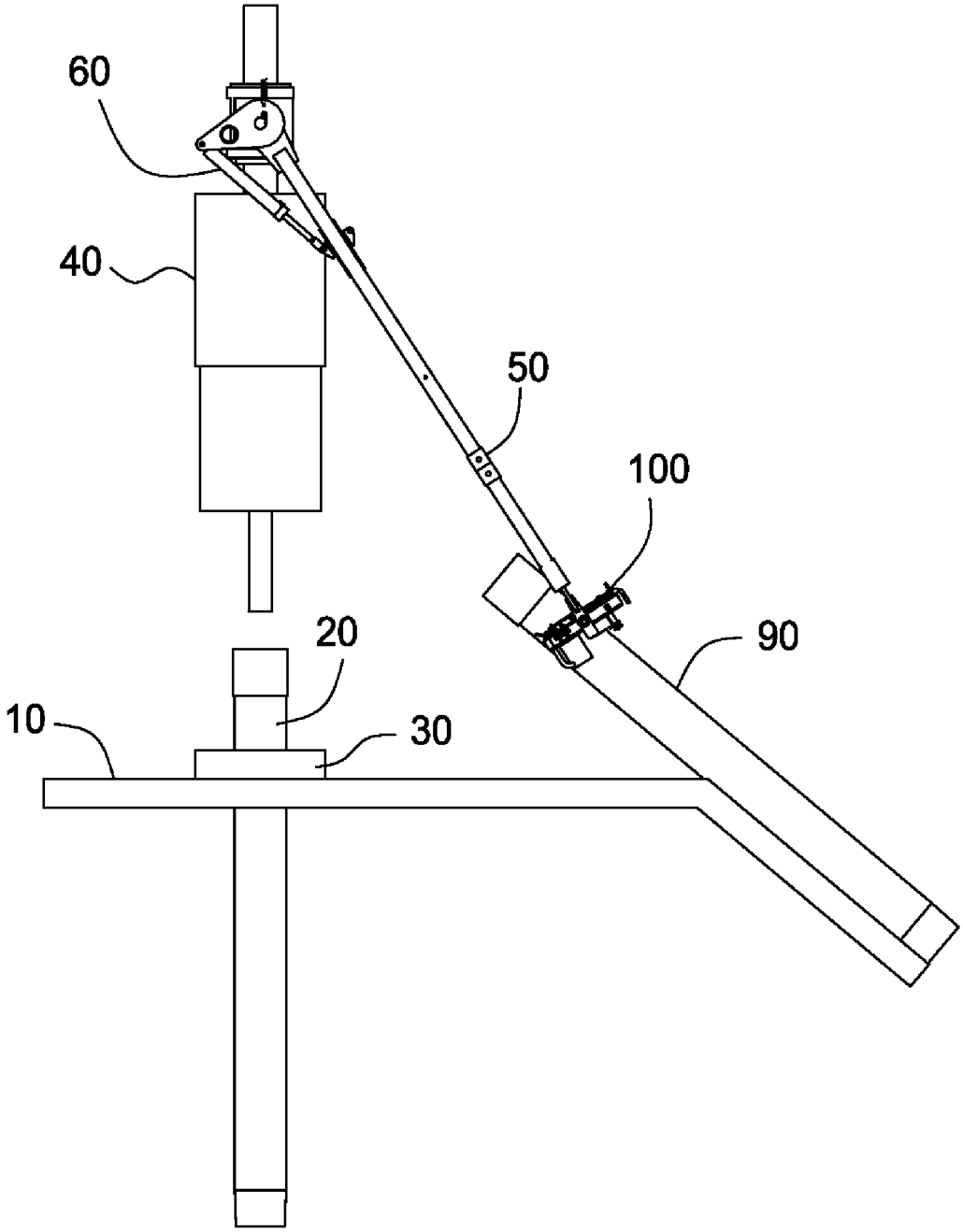
FIGS. 2 and 3 are views illustrating the single joint elevator gripping a tubular.
Figure 3:
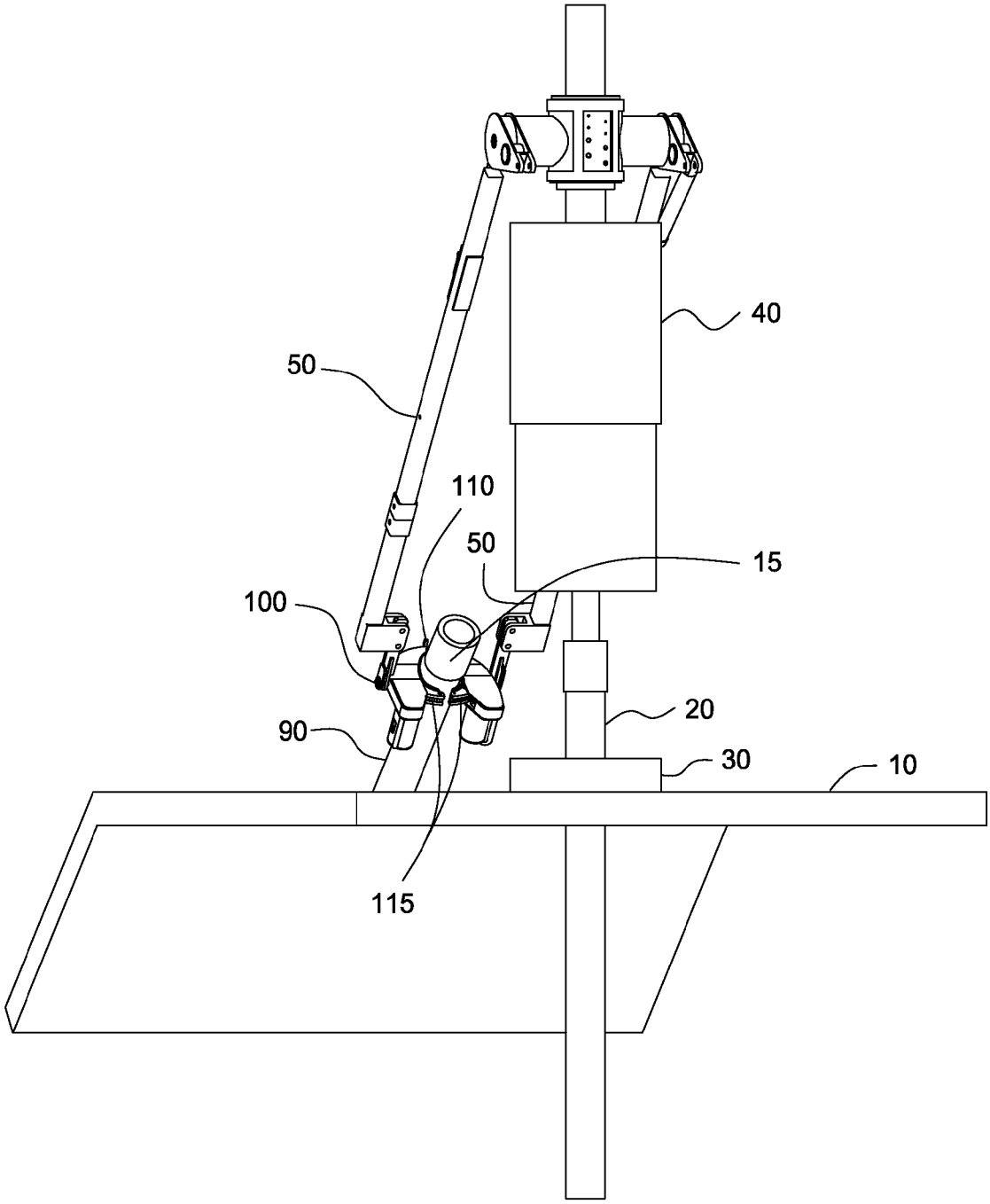

FIGS. 2 and 3 illustrate the interaction between the single joint elevator 100 and the tubular 90. As the bails 50 are lowered down, the single joint elevator 100 moves to an open configuration in order to allow the tubular 90 to be positioned within the single joint elevator 100. Typically, stops 110 on the single joint elevator 100 come in contact with the tubular 90 first, and these stops 110 are adapted to align an access opening of the single joint elevator 100 relative to the tubular 90. FIG. 3 is another view of the single joint elevator 100 after the tubular 90 is positioned within the single joint elevator 100. Thereafter, the single joint elevator 100 moves from the open configuration to a closed configuration. In the closed configuration, the single joint elevator 100 is enclosed around the tubular 90 by closing a pair of closure members 115. In one embodiment, the single joint elevator 100 may optionally include a sensing member (not shown) that is configured to sense when the tubular 90 is positioned in the single joint elevator 100. The sensing member may be activated even before the closure members 115 are closed.

Figure 4:
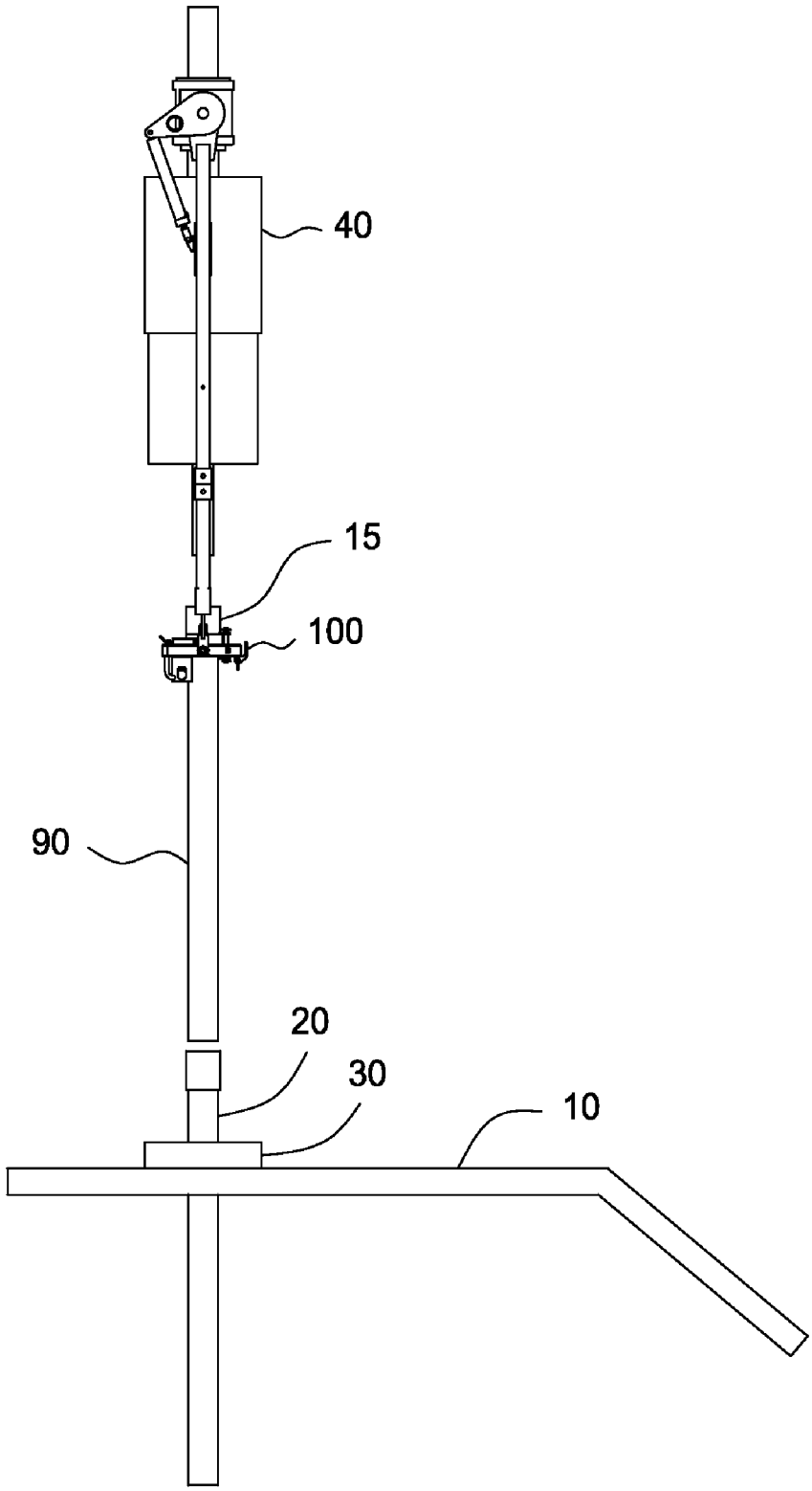
FIG. 4 is a view illustrating the running unit aligning the tubular with a tubular string.

FIG. 4 is a view illustrating the running unit 40 aligning the tubular 90 with the tubular string 20. The running unit 40 is lifted along with the bails 50 which allow the single joint elevator 100 to slide upwards guided by the tubular 90 until the stops 110 of the single joint elevator 100 come in contact with a coupling 15 on the tubular 90. The tubular 90 is lifted further until it is off of the rig floor 10, and thereafter, hanging vertically as shown in FIG. 4. From this configuration, the tubular 90 can be stabbed into the coupling of the tubular string 20. Then, the running unit 40 can facilitate the connection of the tubular 90 with the tubular string 20 and lower the made up tubular string down. However, before the made up tubular string can be lowered down, the single joint elevator 100 is moved from the closed configuration to the open configuration and the bails 50 are swung out. In another embodiment, the joint elevator 100 may be moved to the open configuration and the bails 50 are swung out as the made up tubular is lowered down.

In a further embodiment, the pair of closure members 115 of the single joint elevator 100 may include grippers (not shown). In this embodiment, the running unit 40, the bails 50 and the single joint elevator 100 are lifted until the tubular 90 is raised off of the rig floor 10 as shown in FIG. 4. Next, the bails 50 may be retracted until the tubular 90 is engaged and secured by the running unit 40. An example of retractable bails is described in U.S. Pat. No. 6,527,047 to Bernd-Georg Pietras, which is herein incorporated by reference. Thereafter, the tubular 90 can be stabbed into the coupling of the tubular string 20. At this point, the grippers of the single joint elevator 100 may be released so that the running unit 40 can facilitate the connection of the tubular 90 with the tubular string 20.

Figure 5:
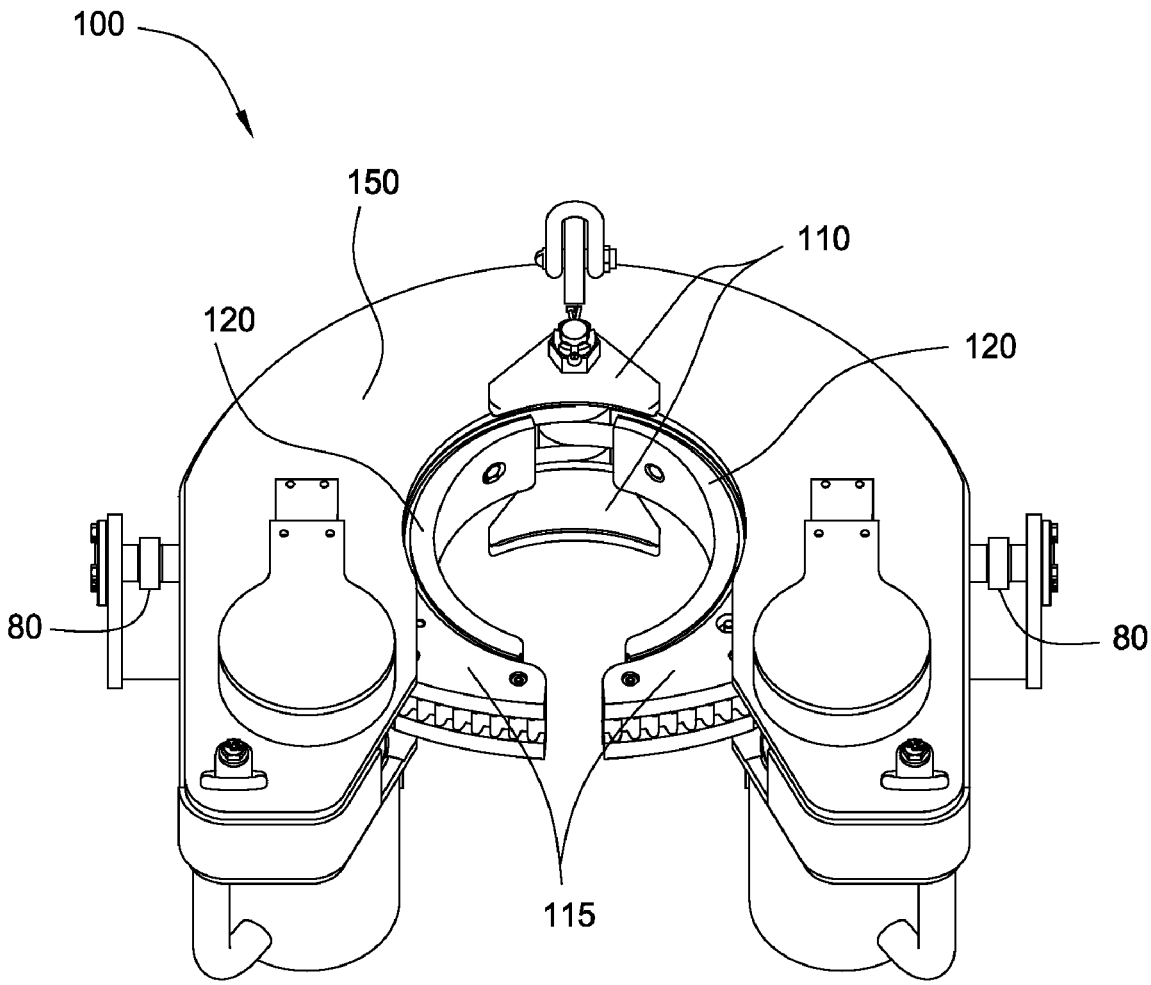
FIGS. 5 and 6 are isometric views of the single joint elevator according to one embodiment of the invention.
Figure 6:
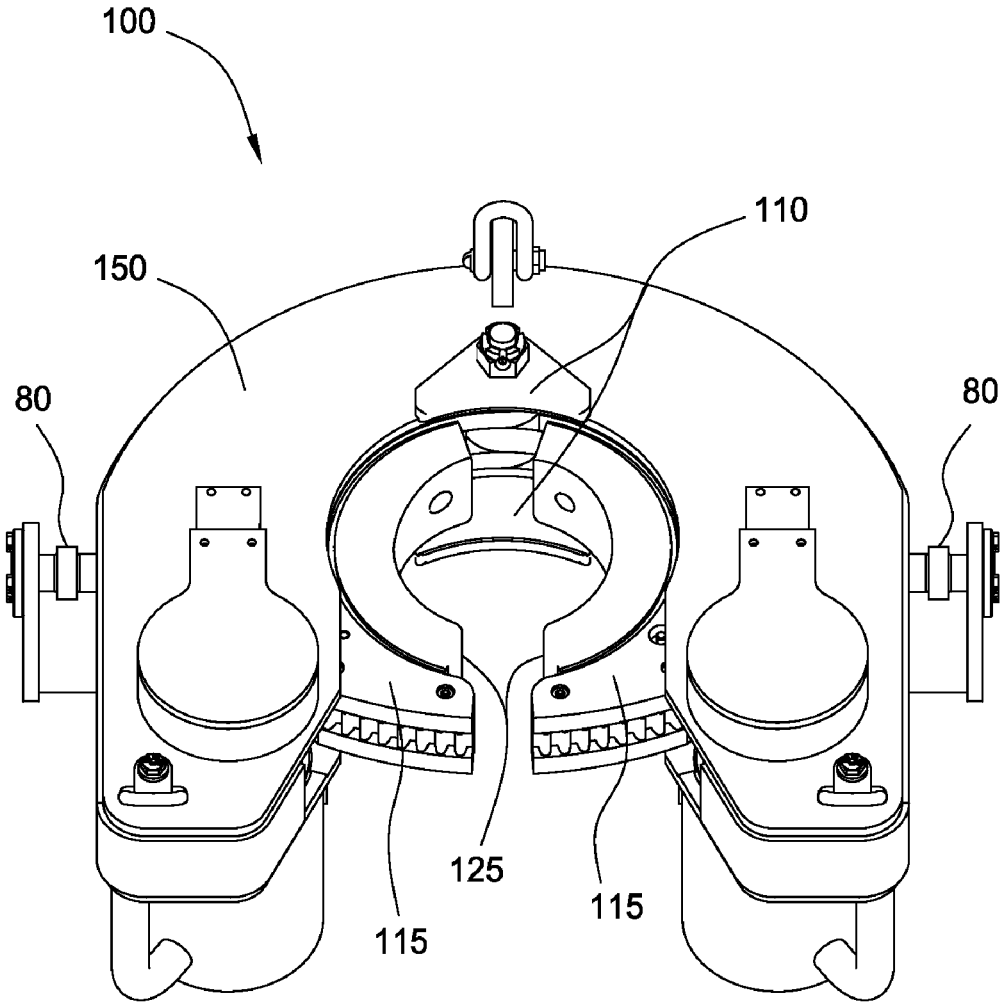

FIG. 5 is an isometric view of the single joint elevator 100 in the closed configuration. As shown, closure members 115 of the single joint elevator 100 are closed. The single joint elevator 100 is provided with the stops 110 which are used to align the single joint elevator 100 relative to the tubular 90. The single joint elevator 100 is also provided with fixtures 80, such as bolts for the connection to the bails 50. The single joint elevator 100 may also include an adapter 120 for use with the tubular. FIG. 6 shows the single joint elevator 100 with adapters 125 suited for smaller casings. Therefore, depending on which adapter is used, the single joint elevator 100 may be utilized for a wide range of casing sizes. Typically, the inside diameter of the adapters is smaller than the O.D. of the coupling of the tubular.

Figure 7B:
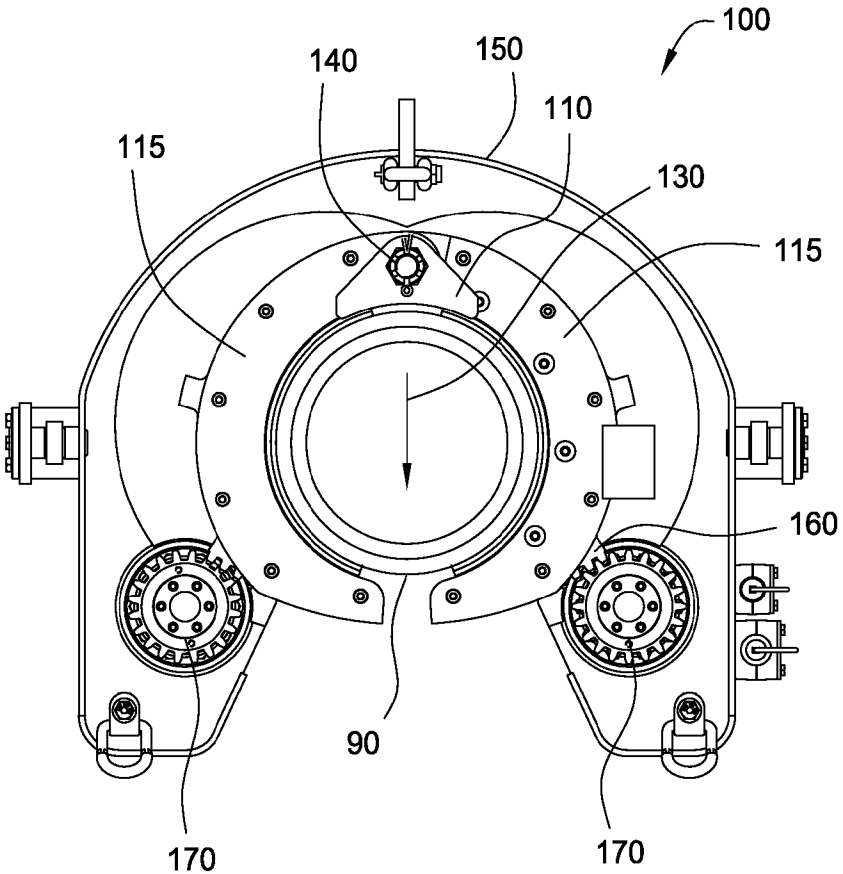
FIGS. 7A and 7B are views of the single joint elevator in an open configuration and a closed configuration.
Figure 7A:
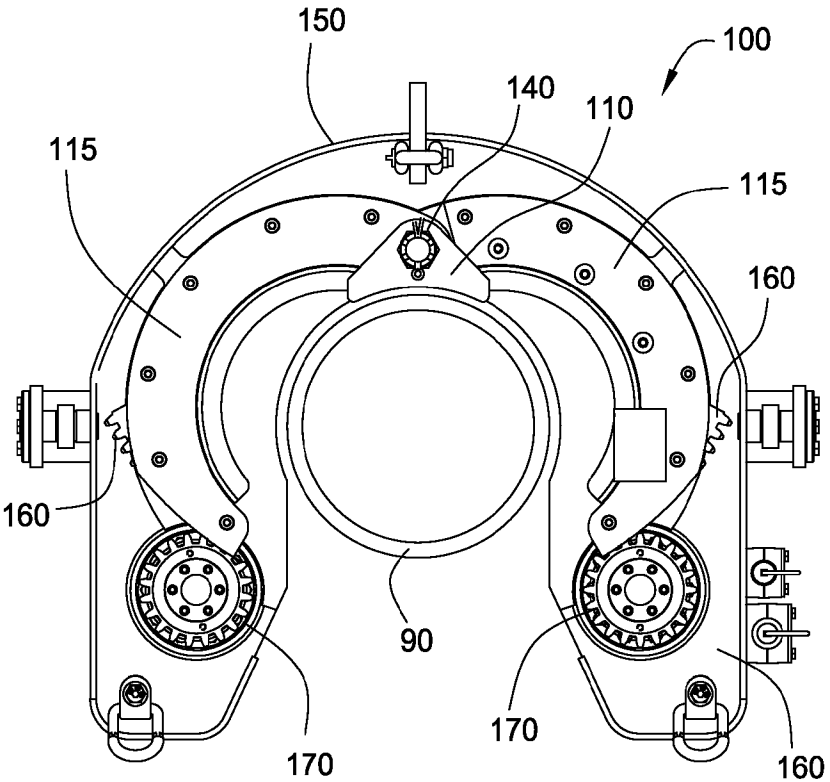
Figure 8:
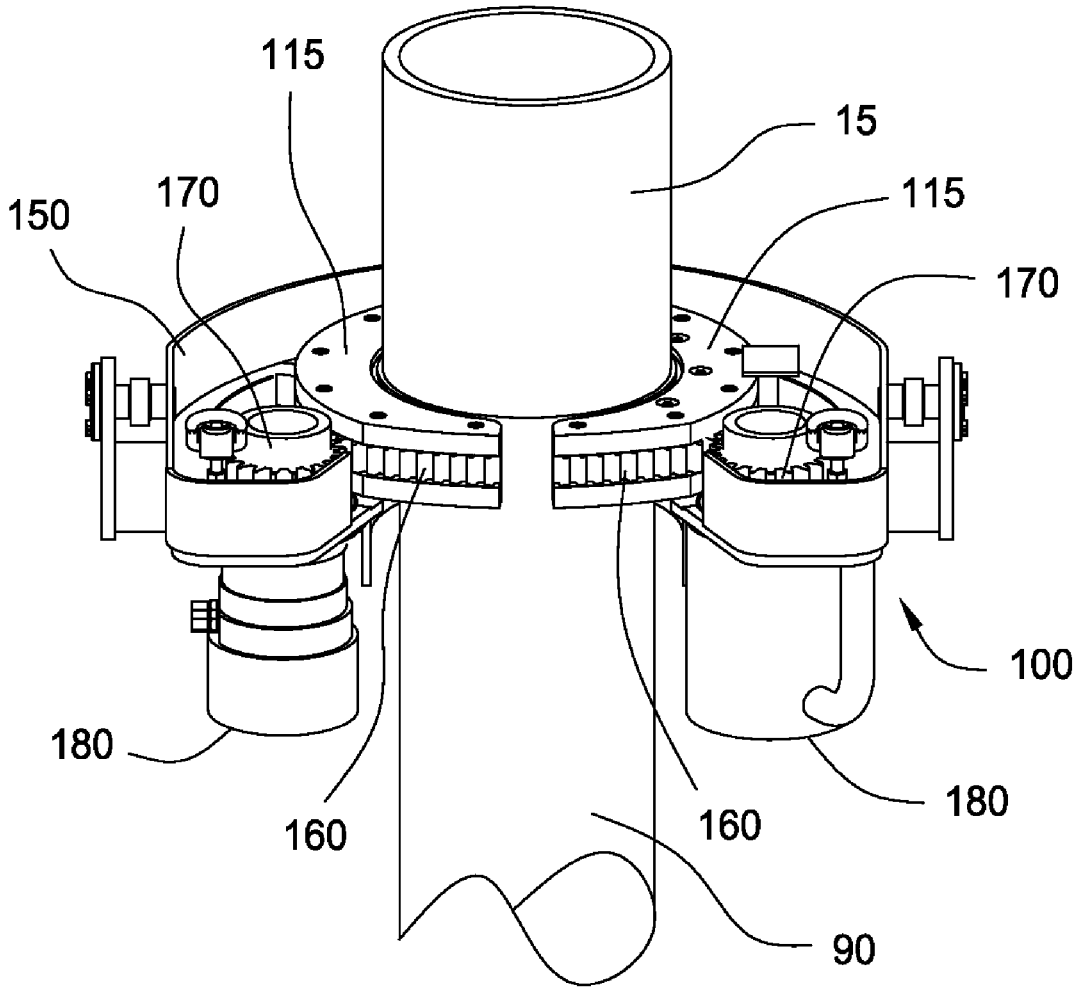
FIG. 8 is a view illustrating the single joint elevator gripping the tubular.

FIGS. 7A and 7B are views of the single joint elevator 100 in an open configuration and a closed configuration. In order to reveal the inner workings of the single joint elevator 100, an upper portion of the housing 150 has been removed. As illustrated, the closure members 115 are pivotally fixed by a hinge pin 140 to the housing 150. Gear segments 160 are coupled to the closure members 115 in a manner such that the center of the gear segments 160 is proximate the center of the hinge pin 140. A power assembly comprising of pinions 170 and motors 180 are engaged with the gear segments 160. One motor 180 drives one pinion 170 in a clockwise direction and the second motor 180 drives the second pinion 170 in a counter-clockwise direction. The pinions 170 will rotate the closure members 115 until the closure members 115 are opened. By reversing the rotation of the motors 180, the closure members 115 will be closed. An arrow 130 shows the direction of the force due to the weight of the tubular 90 during lifting of the casing directly from the V-door at rig side (see FIG. 3). The direction of the force goes to the center of the pivot point of the hinge pin 140. Therefore, the closure members 115 experience a relatively small opening torque applied due to the weight of the tubular 90 as compared to a relatively large torque applied by the motors 180, thereby maintaining the closure members 115 in the closed position.

The motors 180 are standard equipment on the market. Typically, the motor includes brakes having multi-plates. These kinds of brakes are spring loaded and can be released hydraulically. For enhanced safety, the motors can be combined with locking elements like a pin lock. Other possibilities for locking the closure members are ratchets at the pinion or gear segments or locking bolts at the closure members. The locking mechanisms may be locally operated, remotely operated or a combination thereof. Further, the operation of the locking mechanisms may be integrated into the control logic for the operation of the joint elevator.

Figure 9A:
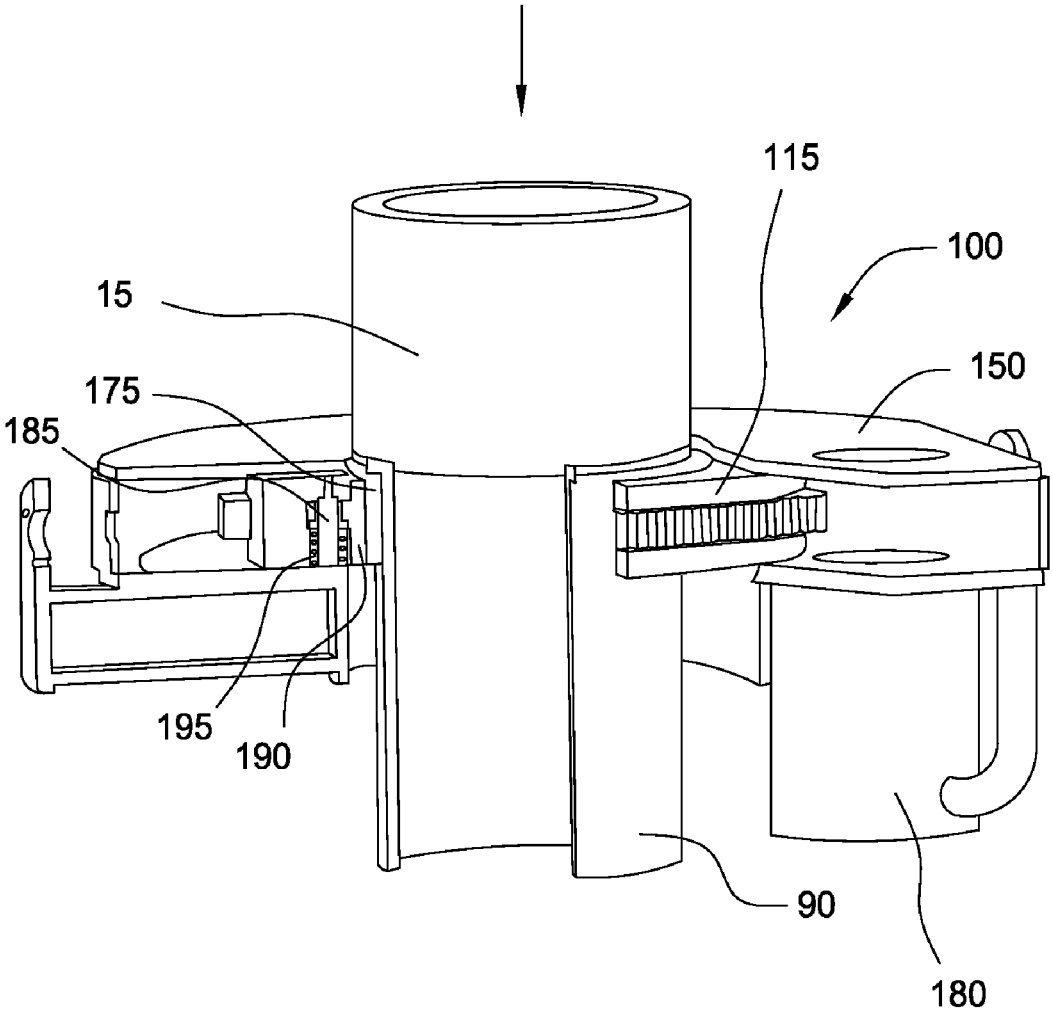
FIGS. 9A and 9B are views of a locking system in the single joint elevator.
Figure 9B:
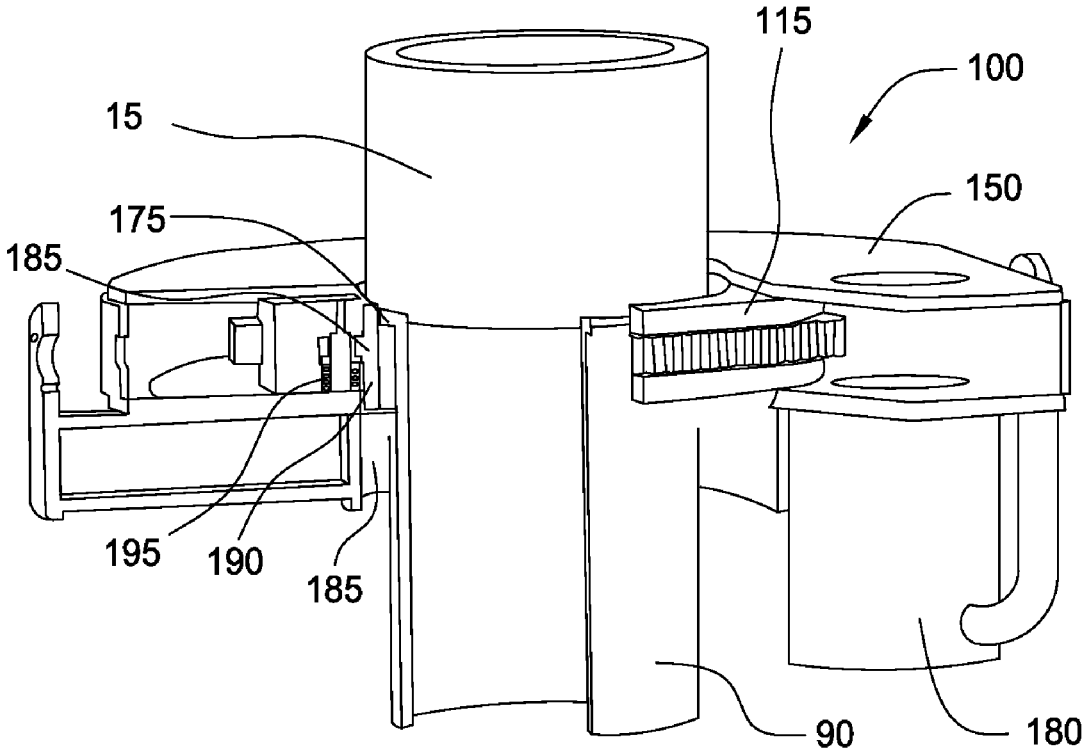

In one embodiment, the single joint elevator 100 may include a lock assembly 185 as shown in FIGS. 9A and 9B. The lock assembly 185 may be configured to send a signal to the motors 180 to indicate that the single joint elevator 100 is lifting the tubular 90. The signal is used by the motor 180 to lock the brakes so that the single joint elevator 100 cannot be opened. In operation, the single joint elevator 100 moves from the open configuration to the close configuration which causes the closure members 115 to close around the tubular (see FIG. 3). Thereafter, the running unit 40 is lifted along with the bails 50 which cause the single joint elevator 100 to slide upwards guided by the tubular 90 until the stops 110 of the single joint elevator 100 come in contact with the coupling 15 on the tubular 90 as shown in FIG. 9A. As the tubular 90 is lifted, the coupling 15 loads a ring 175 which causes a bushing 190 to compress a biasing member 195, such as a spring, as shown in FIG. 9B. The compression of the biasing member 195 causes the ring 175 to be displaced on the outside of the housing 150 perpendicular to the operating plane of the closure members 115. This action prevents inadvertent release of the tubular 90 from the single joint elevator 100. Additionally, it should be noted that the other embodiments described herein may use a similar lock assembly to generate a signal that locks the power assembly (e.g. motors or cylinders) and/or the use of a similar ring assembly which is used to prevent inadvertent release of the tubular 90.

Operation of the single joint elevator 100 may be incorporated as part of a safety interlock system which may be configured to confirm that a tubular is securely held by the single joint elevator 100 and prevent inadvertent release of the tubular from the single joint elevator 100. For instance, the signal which locks the power assembly may be incorporated in the safety interlock of the entire tubular handling system. The safety interlock system may be further configured to interact with the control systems of other tubular handling equipment in use simultaneously with the single joint elevator 100 (such as top drive, casing running tools, rig floor spider, tongs, etc.) in order to ensure appropriate coordination of the tubular handling operation.

Figure 10:
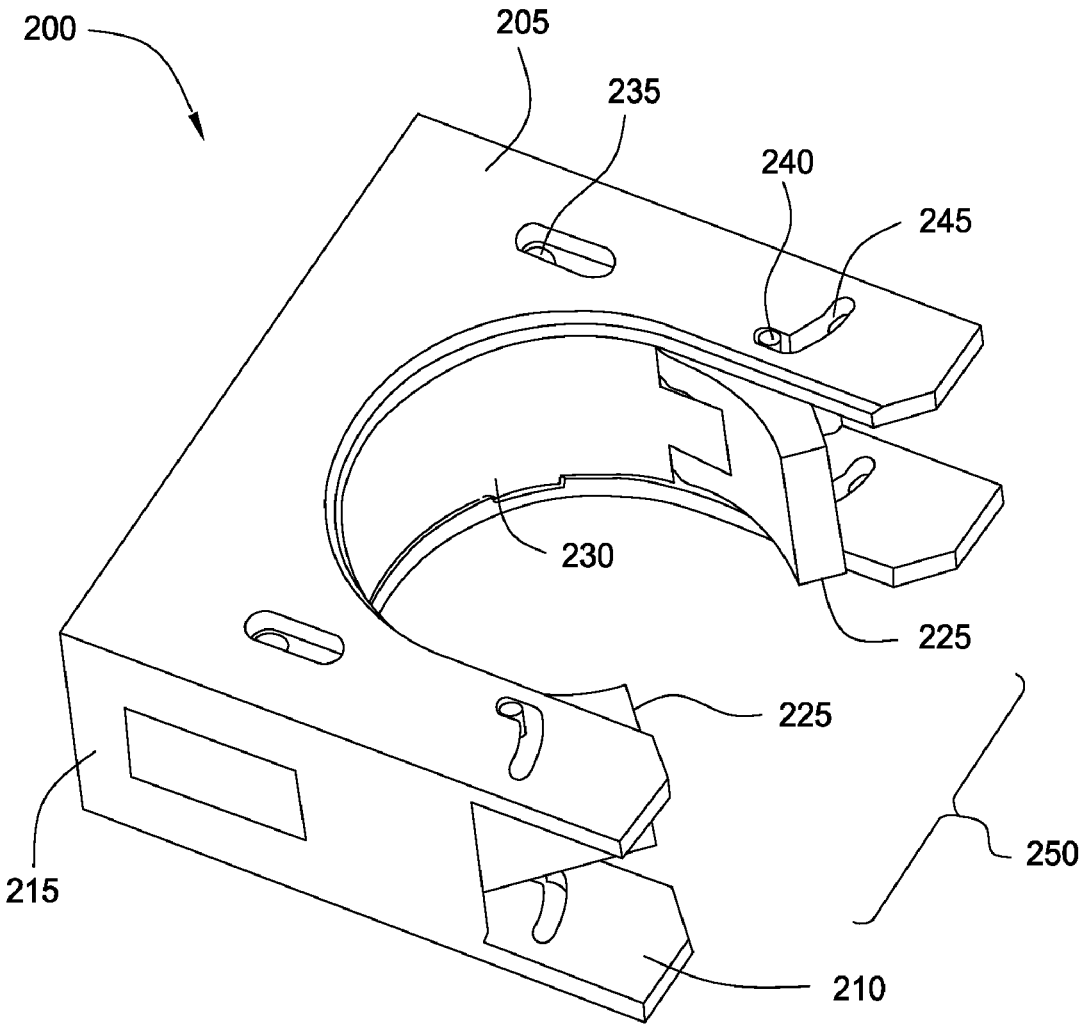
FIG. 10 is a view illustrating a remotely operated single joint elevator according to one embodiment of the invention.

FIG. 10 is a view illustrating a remotely operated single joint elevator 200 according to one embodiment of the invention. The single joint elevator 200 includes a housing 215 that encloses the moving parts. The housing 215 generally includes an upper plate 205 and a lower plate 210. The upper and lower plates 205, 210 each define an access opening 250 in one side of the housing 215, through which a tubular may be moved into and out of the single joint elevator 200. When a tubular is positioned within the single joint elevator 200, it may be retained by closure members 225 closed around it. The closure members 225 shown in FIG. 10 do not necessarily close the entire space of the access opening 250, but in some embodiments it is contemplated that the closure members 225 may indeed close the entire access opening 250. The closure members 225 are hingedly connected to a movable body 230, which is held within the housing 215. As such, the closure members 225 are able to pivot in order to selectively open and close the access opening 250. Each closure member 225, furthermore, has a closure member pin 240 protruding above and/or below it. The closure member pins 240 are engaged within respective guide slots 245 within the upper and/or lower plates 205, 210. Therefore, pivotal motion of the closure members 225 may be guided by the travel of the closure member pins 240 within their respective guide slots 245. In the illustrated example, the guide slots 245 define a "J", with the closure member pins 240 located at one end of the "J." It is evident that in FIG. 10 with the closure member pins 240 in their illustrated configuration within their respective slots 245, the slot 245 configuration dictates that the closure members 225 may not be able to pivot until the closure member pins 240 have traveled laterally toward the access opening 250. As such, as shown in FIG. 10, the closure members 225 are retained in the closed configuration. As described, the guide slots are in the plates 205, 210 and the pin attached to the closure member 225, however it should be noted that the pins and/or the slots are interchangeable such that they may be part of either component, without departing from principles of the present invention.

It is envisaged that the housing 215, the access opening 250, the moveable body 230 and the closure members 225 are so shaped and sized to provide a close fit around the cylindrical bodies of the tubulars being handled by the single joint elevator 200. In order to be able to handle tubulars of smaller sizes, adapters may be fitted to the inner concave surface of the body 230 and the closure members 225, as appropriate.

Figure 11:
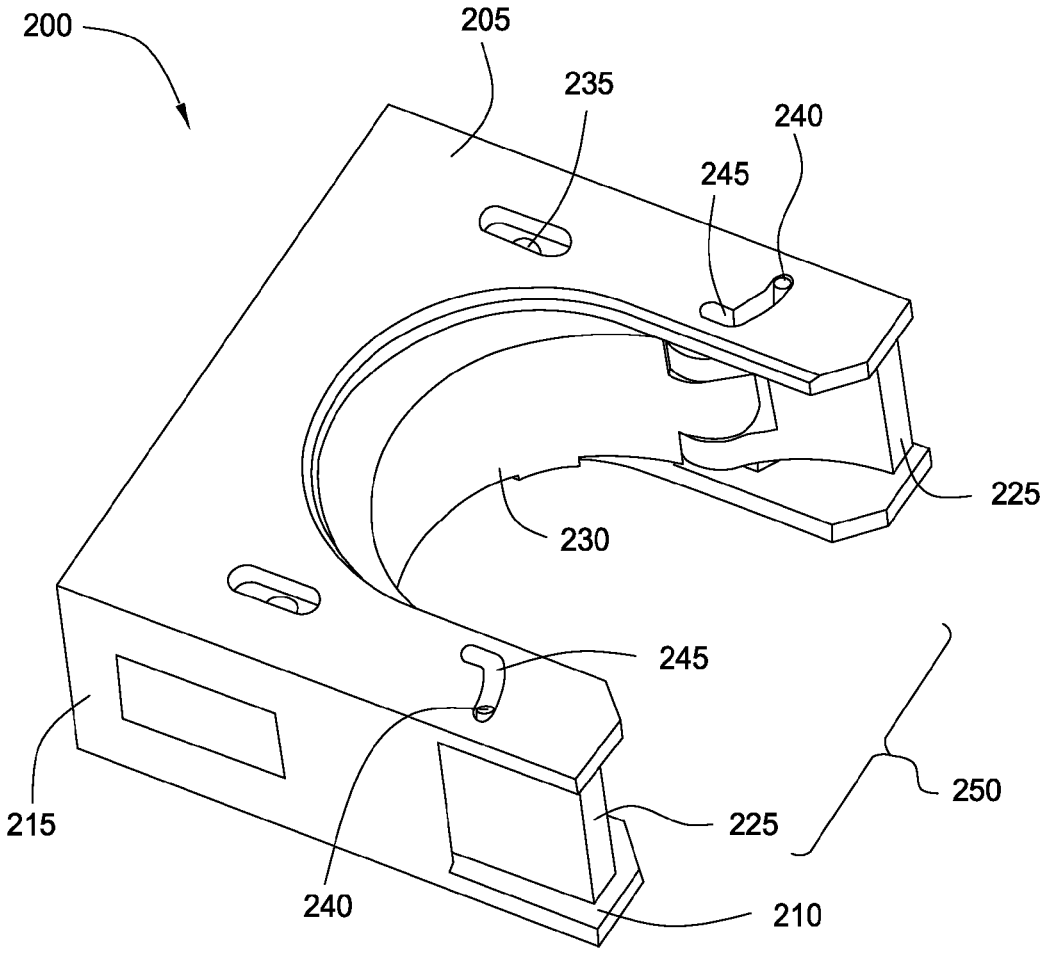
FIG. 11 is a view illustrating the single joint elevator in an open configuration.

FIG. 11 is a view illustrating the single joint elevator in an open configuration. It can be seen that the closure member pins 240 are now located at the opposite ends of the guide slots 245, and the closure members 225 have been pivoted about the hinges connecting them to the body 230. Also evident in FIG. 11 is that the closure members 225 and the body 230 have traveled towards the access opening 250 in the housing 215.

Figure 12:
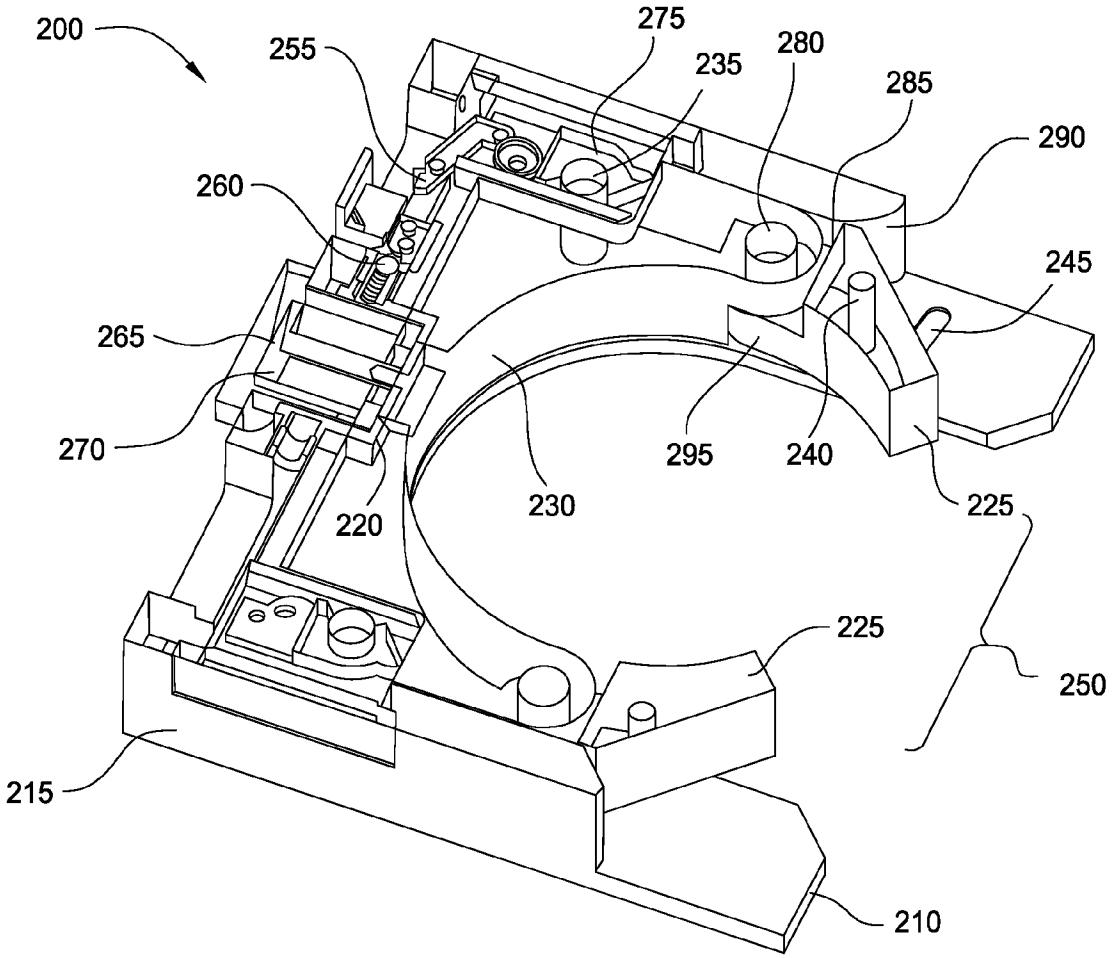
FIG. 12 is a view illustrating the components of the single joint elevator.

FIG. 12 is a view illustrating the components of the single joint elevator 200. In FIG. 12, the upper plate 205 has been omitted to reveal the inner workings, and the major components are shown hollowed to further illustrate their juxtaposition within the single joint elevator 200. Starting with the closure members 225 with respect to the movable body 230, each closure member 225 has a hinge tab portion 295, through which a hinge pin 280 is located. The hinge pin 280 is also located through a part of the movable body 230. The back sides (or outside surfaces) of the closure member hinge tab portions 295 interact with inner surfaces on the side of the housing 215. More specifically, the closure member hinge tab portions 295 interact with a cam surface 290 and a locking surface 285 of the housing 215. As will be illustrated below, motion of the body 230 towards and away from the access opening 250, combined with the interaction between the closure member pins 240 and the guide slots 245 causes the back sides of the closure member hinge tab portions 295 to bear against the respective cam surfaces 290 while the closure members 225 are opening or closing. Furthermore, when in the closed configuration (as shown in FIG. 12), the back sides of the closure member hinge tab portions 295 interact with the respective locking surfaces 285. As such, in this closed configuration, the closure members 225 are prevented from pivoting outwards.

The body 230 is movable within the housing 215 laterally towards and away from the access opening 250. This is accomplished by pressurizing against power assembly comprising a piston 265 and a chamber 270. It is contemplated that the piston 265 may be hydraulic or pneumatic. In an alternative embodiment, a spring or other form of biasing member may be provided within the chamber 270, such that the body 230 may be biased to be positioned away from the access opening 250. As such, in this embodiment, the closure members 225 may therefore be biased to the closed configuration.

Since lateral motion of the body 215 determines whether the closure members 225 open or close, a further (and optional) feature illustrated in FIG. 12 is a latch 275 configured to retain the body 230 from moving toward the access opening 250. The latch 275 and its associated mechanism are illustrated on one side of the housing 215 for clarity however; it is contemplated that a similar arrangement may be present on the other side. Additionally, similar arrangements may be provided in corresponding locations on the underside of the body 230. The latch 275 is fixed to the housing 215, and, as shown here, engages with a latch pin 235. The latch pin 235 is fixed to the body 230. Therefore in the configuration shown FIG. 12, the body 230 is restrained from lateral motion by the latch 275. The latch 275 is movable to enable engagement and disengagement with the latch pin 235, this movement being selectively facilitated by a latch mechanism 255 attached to the latch 275. The latch 275 itself may be sprung or biased, preferably to the closed (or "latched") configuration as shown in FIG. 12. A latch control may also be provided to prevent the inadvertent release of the latch 275.

Also illustrated in FIG. 12 is a latch trigger 260. When the cylinder 265 is attached to a bracket 220 which will unlock the latch 275 via the latch linkage mechanism 255 before engaging the body 230. The trigger 260 continues to open the latch 275 as the trigger 260 pass the linkage mechanism 255 and the pin 235, connected to the body 230, moves away from the latch 275. The latch pin 235 will clear the latch 275 simultaneously with the trigger 260 clearing the linkage 255. The linkage mechanism 255 will not move in opposite direction therefore the latch trigger 260 contains a spring that allows it to retract during the closing function as it passes the Linkage mechanism 255. An indicator may be incorporated as part of a safety interlock system. Such a system may be configured to confirm that a tubular is securely held by the single joint elevator 200 and prevent inadvertent release of the tubular from the single joint elevator 200. The safety interlock system may be further configured to interact with the control systems of other tubular handling equipment in use simultaneously with the single joint elevator 200 (such as top drive, casing running tools, rig floor spider, tongs, etc.) in order to ensure appropriate coordination of the tubular handling operation.

Figure 13:
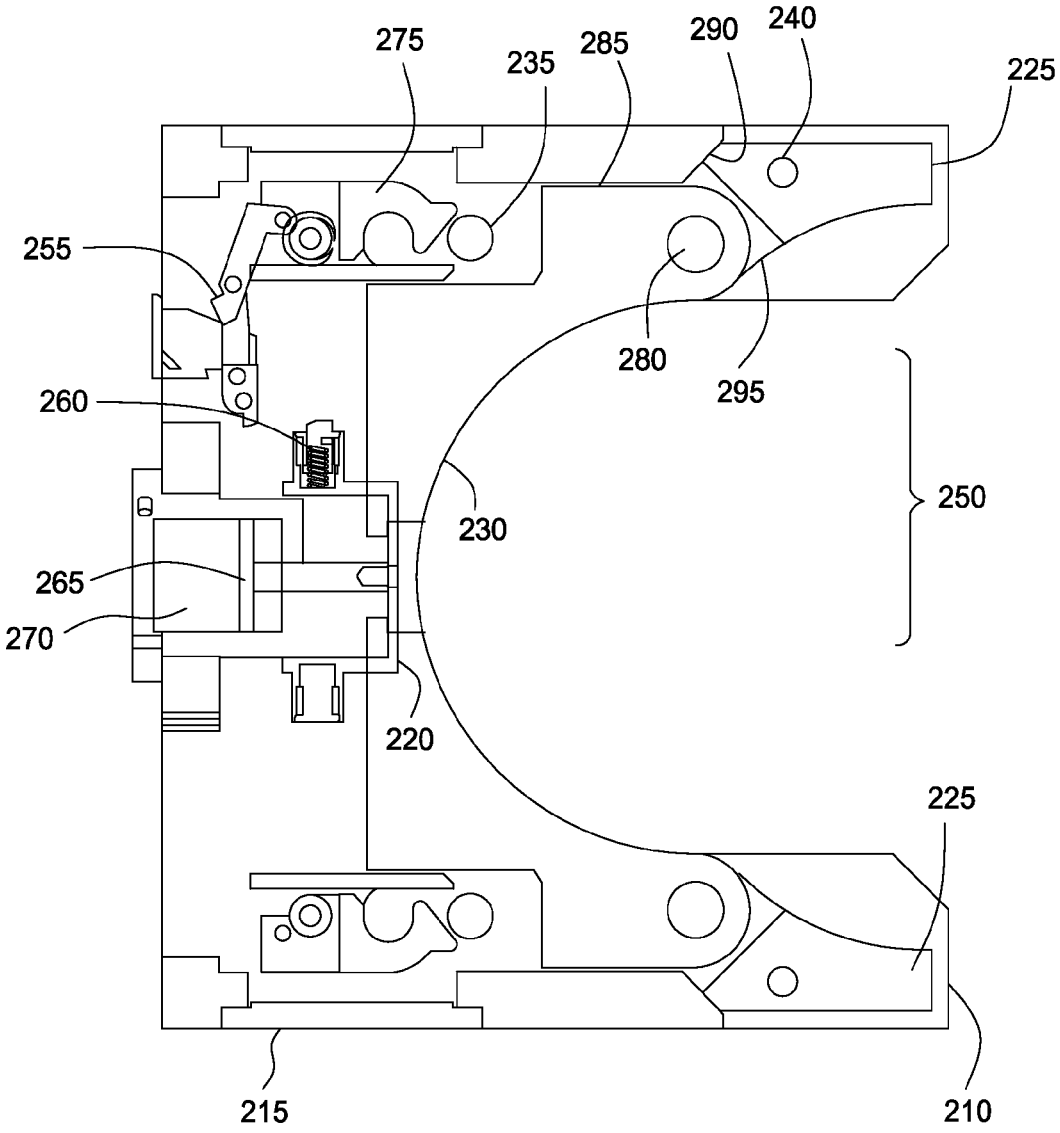
FIGS. 13-15 are views illustrating the single joint elevator as the single joint elevator is operated from the open configuration to a closed configuration.
Figure 14:
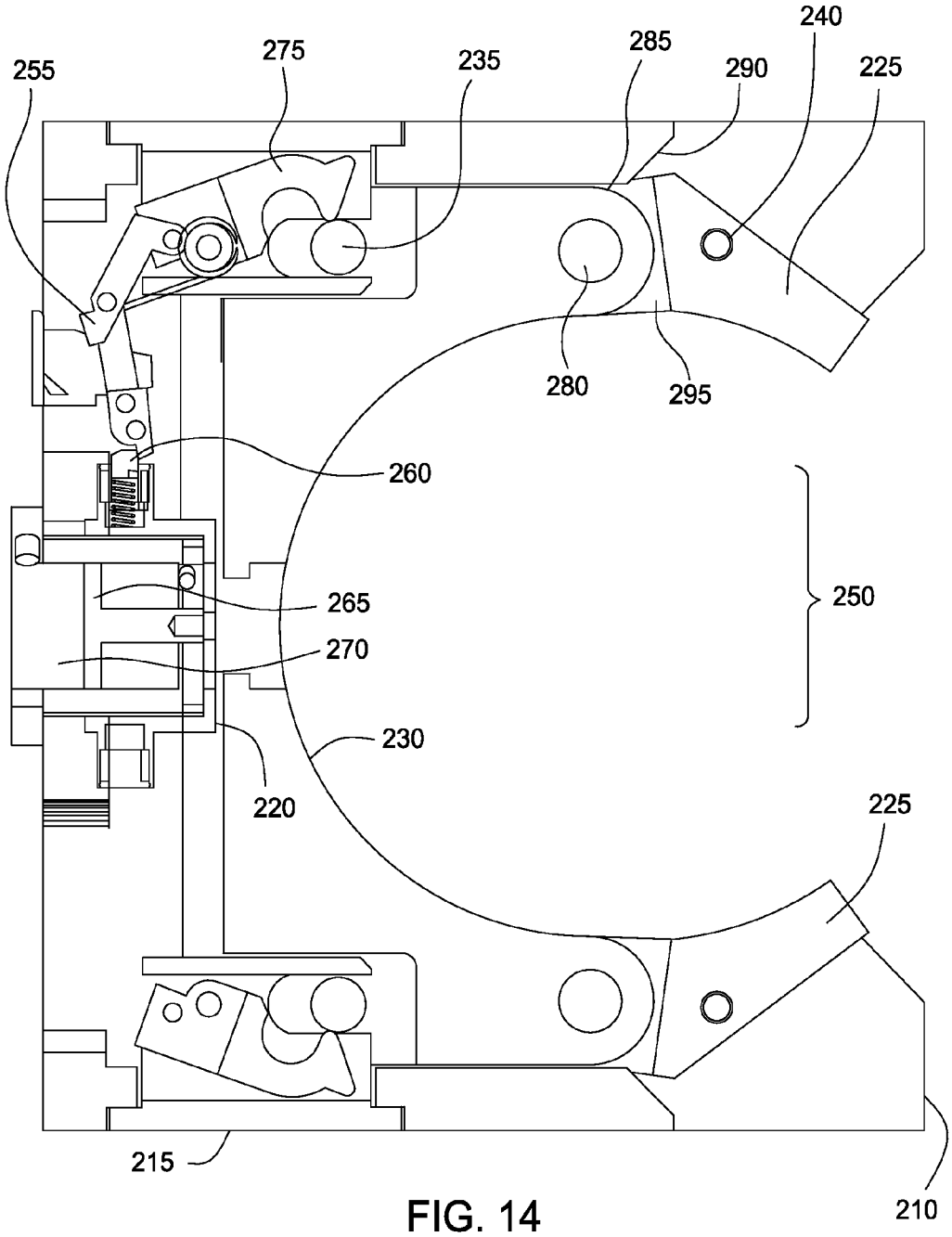
Figure 15:
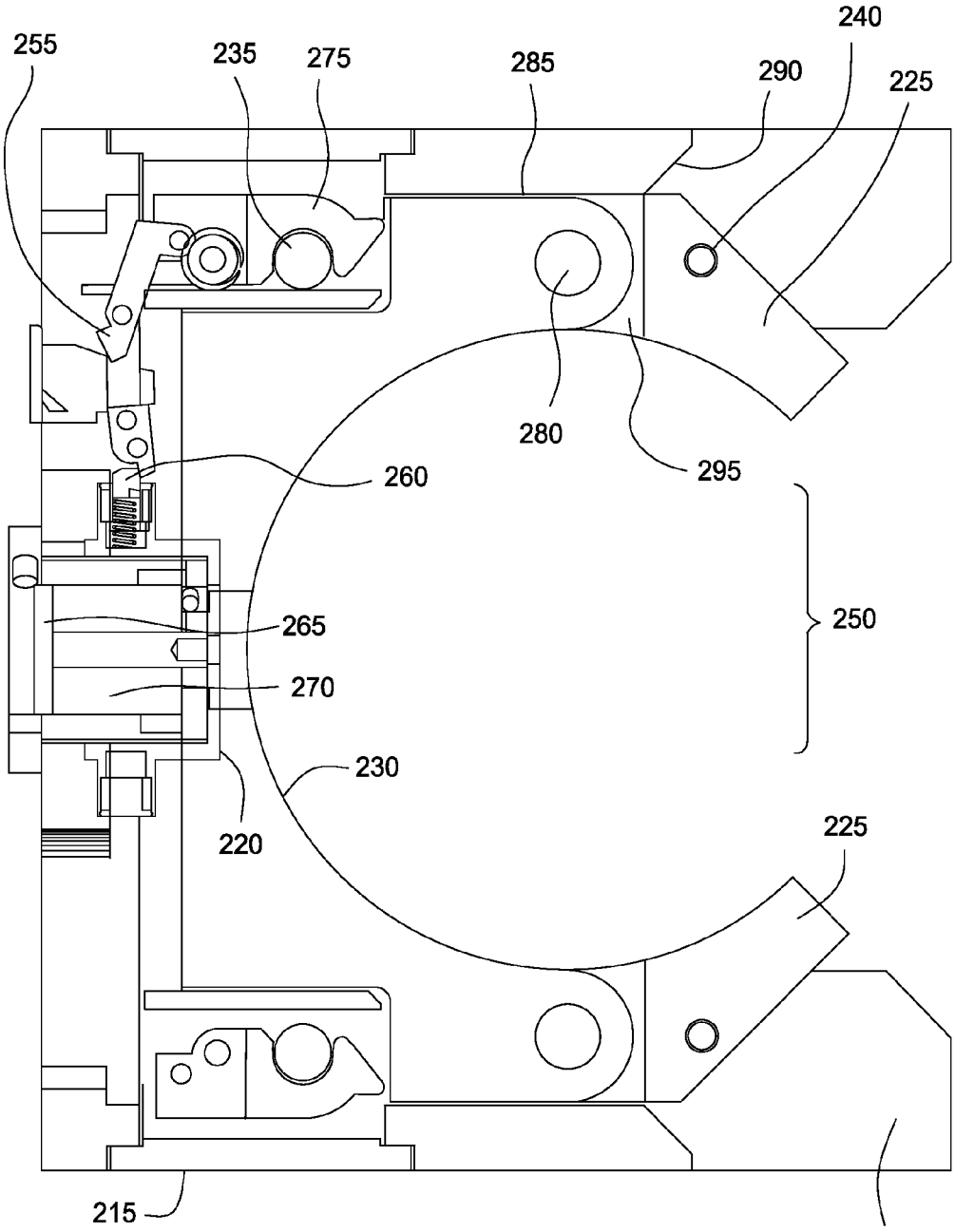

FIGS. 13-15 are views illustrating the single joint elevator 200 as the single joint elevator 200 is operated from the open configuration to the closed configuration. It is envisaged that a tubular is moved into the access opening 250 such that its longitudinal axis extends substantially perpendicular to the plane of the illustration. As illustrated in FIG. 13, the piston 265 has displaced the body 230 laterally toward the access opening 250. The latch 275 is disengaged from the latch pin 235 and the trigger 260 is positioned away from the latch mechanism 255. The closure members 225 are in the open configuration, and the back sides of the closure member hinge tab portions 295 are bearing against respective cam surfaces 290 of the housing 215.

In FIG. 14, the single joint elevator 200 is shown moving from the open configuration to the closed configuration. The backsides of the closure member hinge tab portions 295 are bearing against the juncture of the respective cam surfaces 290 and locking surfaces 285. The latch pin 235 is causing the latch 275 to open, and the latch mechanism 255 is interacting with the trigger 260.

In FIG. 15, the single joint elevator is the closed configuration. As shown, the closure members 225 are in their closed positions, thereby preventing the tubular from exiting the access opening 250. The backsides of the closure member hinge tab portions 295 are bearing against the respective locking surfaces 285. The latch 275 has closed around the latch pin 235, thereby preventing further movement of the body 230 relative to the housing 215.

Figure 16:
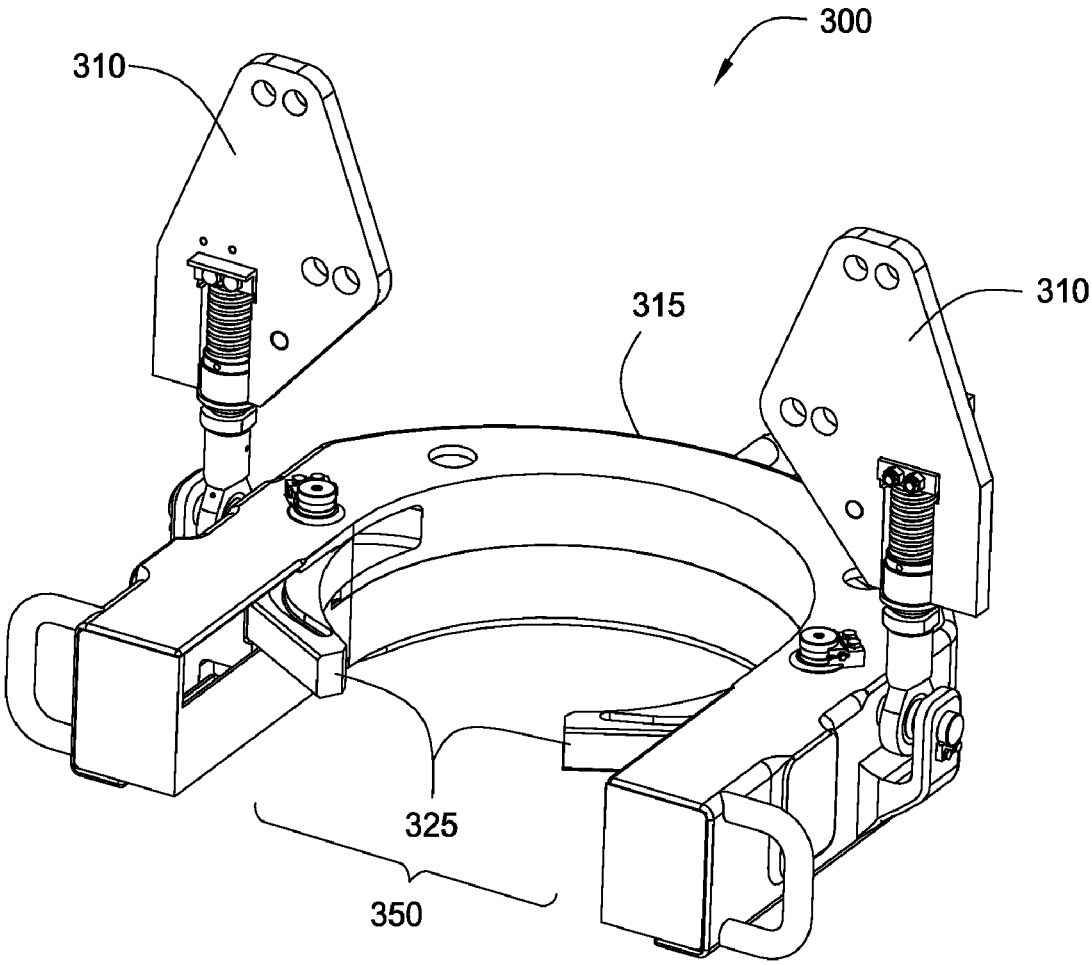
FIG. 16 is a view illustrating a remotely operated single joint elevator according to one embodiment of the invention.

FIG. 16 is a view illustrating a remotely operated single joint elevator according to one embodiment of the invention. The single joint elevator 300 includes a housing 315 that encloses the moving parts. An access opening 350 is defined on one side of the housing 315, through which a tubular may be moved into and out of the single joint elevator 300. When a tubular is positioned within the single joint elevator 300, it may be retained by closure members 325 closed around it. The closure members 325 shown in FIG. 16 do not necessarily close the entire space of the access opening 350, but in some embodiments it is contemplated that the closure members 325 may close the entire access opening 350. The single joint elevator 300 also includes connection plates 310 which are used to connect the single joint elevator 300 to the bails. In other embodiments, the single joint elevator 300 may be connected to the bails by any type of connection assembly, such as lifting lugs on the single joint elevator on which rings on the bails fit over.

Figure 17:
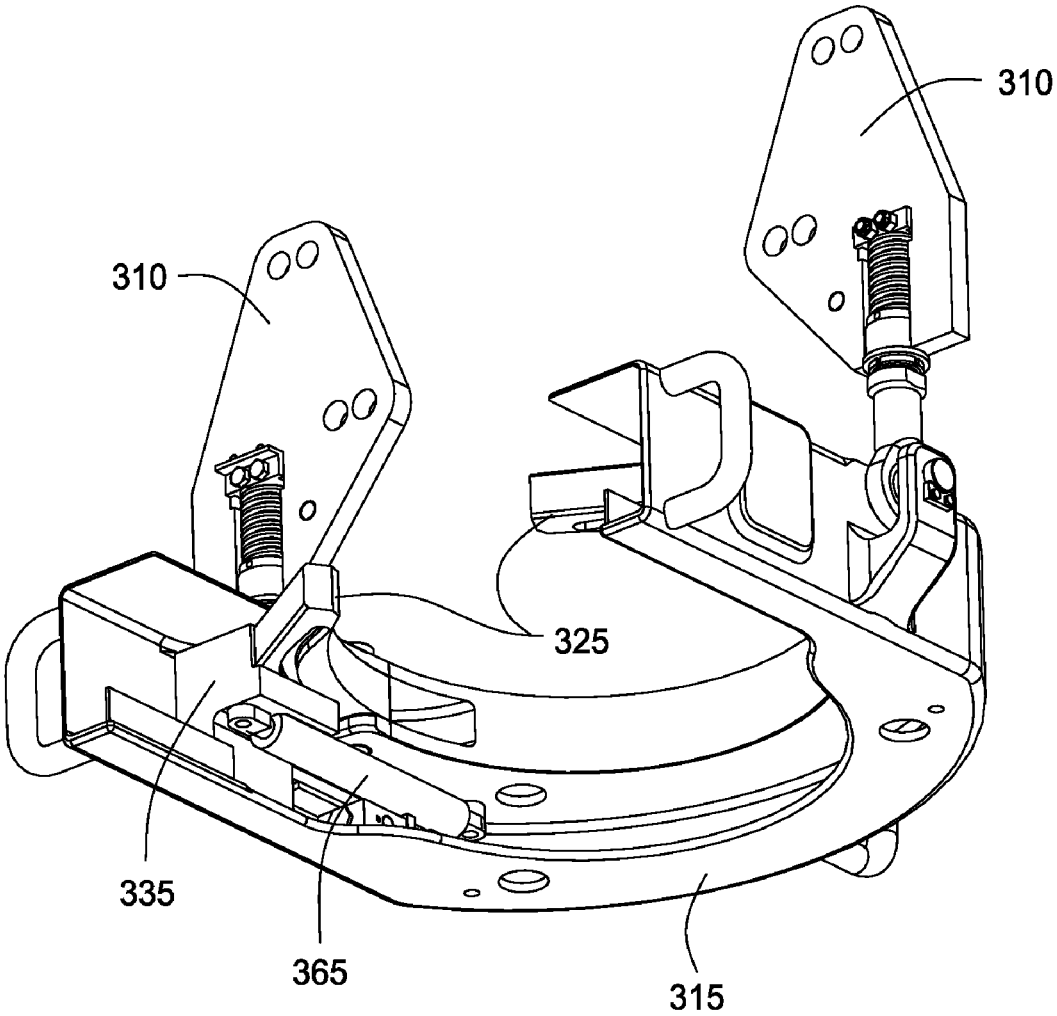
FIG. 17 is a bottom view of the single joint elevator.

FIG. 17 is a bottom view of the single joint elevator 300. For clarity, a portion of the housing 315 has been removed. As shown, the single joint elevator 300 includes a power assembly comprising a cylinder 365 and a wedge block 335. The cylinder 365 may be hydraulic or pneumatic. In an alternative embodiment, a spring or other form of biasing member may be provided to bias the wedge block 335. As will be discussed herein, the cylinder 365 and the wedge block 335 are configured to selectively move the closure members 325 between an open position and a closed position. The single joint elevator 300 may also include an adapter for use with the tubular which allows the single joint elevator 300 to be utilized for a wide range of casing sizes. Typically, the inside diameter of the adapter is smaller than the O.D. of the coupling of the tubular.

Figure 18B:
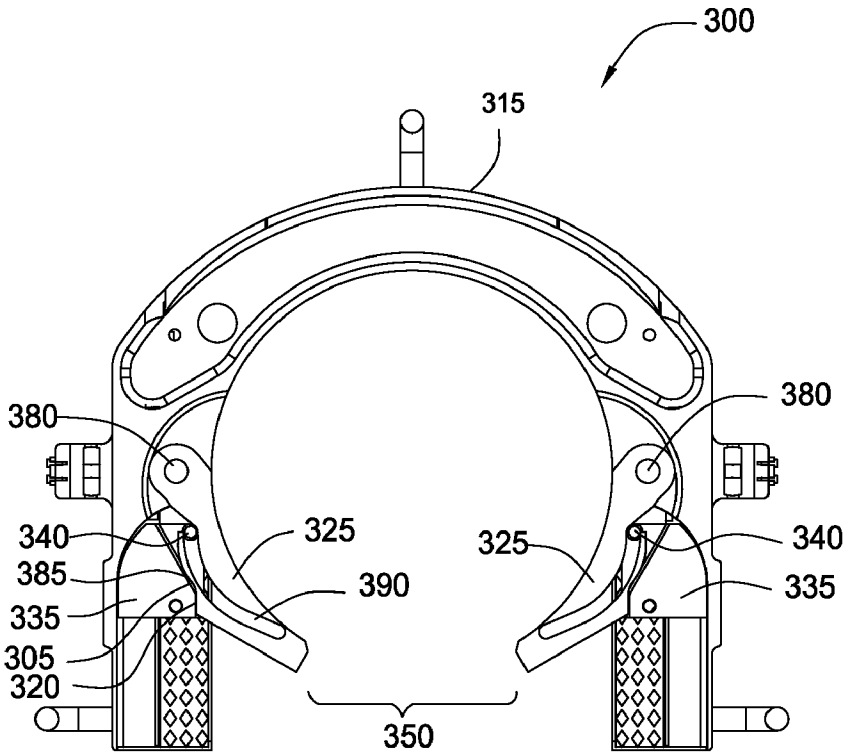
FIGS. 18A and 18B are views of the single joint elevator in an open configuration and a closed configuration.
Figure 18A:
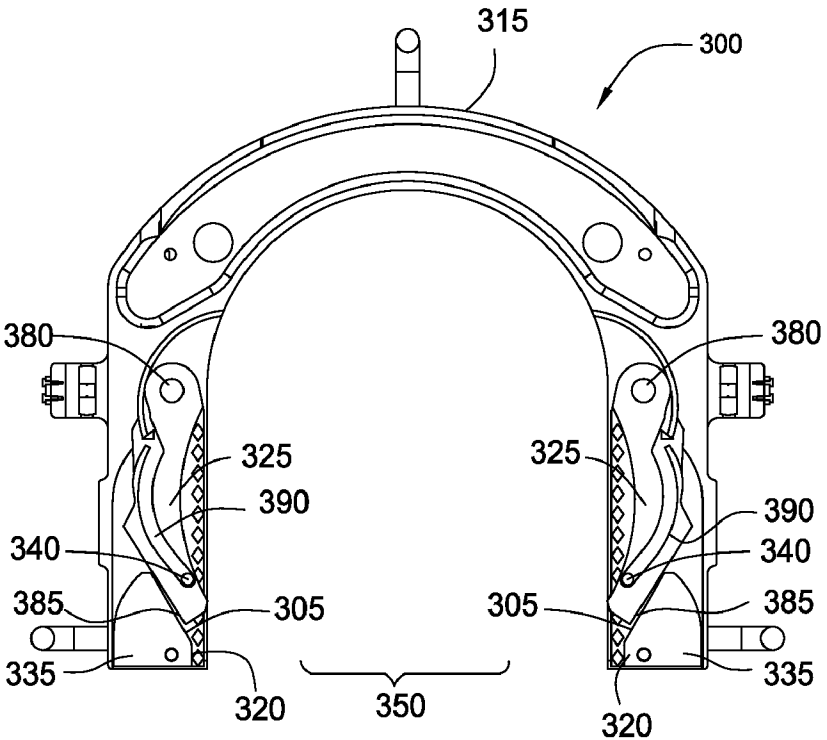

FIGS. 18A and 18B are views of the single joint elevator 300 in an open configuration and a closed configuration. In order to reveal the inner workings of the single joint elevator 300, an upper portion of the housing 315 has been removed. The closure members 325 are hingedly connected to the housing 315 via a hinge pin 380. As such, the closure members 325 are able to pivot in order to selectively open and close the access opening 350. Each closure member 325 includes a guide slot 390 that interacts with a closure member pin 340 protruding from the wedge block 335. As a result, pivotal motion of the closure members 325 may be guided by the travel of the closure member pins 340 within their respective guide slots 390. Each closure member 325 also has a side portion 385 which interacts with the surfaces on the wedge block 335. More specifically, the side portion 385 interacts with a cam surface 305 and a locking surface 320 of the wedge block 335. The movement of the wedge block 335 towards and away from the access opening 350, combined with the interaction between the closure member pins 340 and the guide slots 390 causes the side portion 385 of the closure member 325 to bear against the respective cam surfaces 305 while the closure members 325 are opening or closing. Furthermore, when in the closed configuration (as shown in FIG. 18B), the side portion 385 of the closure member 325 interact with the respective locking surfaces 320. As such, in this closed configuration, the closure members 325 are prevented from pivoting outwards. As described, the guide slots are in the closure member 325 and the pin attached to the wedge block 335, however it should be noted that the pins and/or the slots are interchangeable such that they may be part of either component, without departing from principles of the present invention.

The body wedge block 335 is movable within the housing 315 laterally towards and away from the access opening 350. This is accomplished by pressurizing the cylinder 365. It is envisaged that a tubular is moved into the access opening 350 such that its longitudinal axis extends substantially perpendicular to the plane of the illustration. As illustrated in FIG. 18A, the cylinder 365 has displaced the wedge block 335 laterally toward the access opening 350. The closure members 325 are in the open position, and the side portion 385 of the closure members 335 are bearing against respective cam surfaces 305 of the wedge block 335.

In FIG. 18B, the single joint elevator 300 is the closed configuration. As shown, the closure members 325 are in their closed positions, thereby preventing the tubular from exiting the access opening 350. The cylinder 365 has displaced the wedge block 335 laterally away from the access opening 350, thereby causing the closure members 325 to move toward the access opening 350. The side portion 385 of the closure members 325 are bearing against the respective locking surfaces 320 of the wedge block 335.

Figure 19:
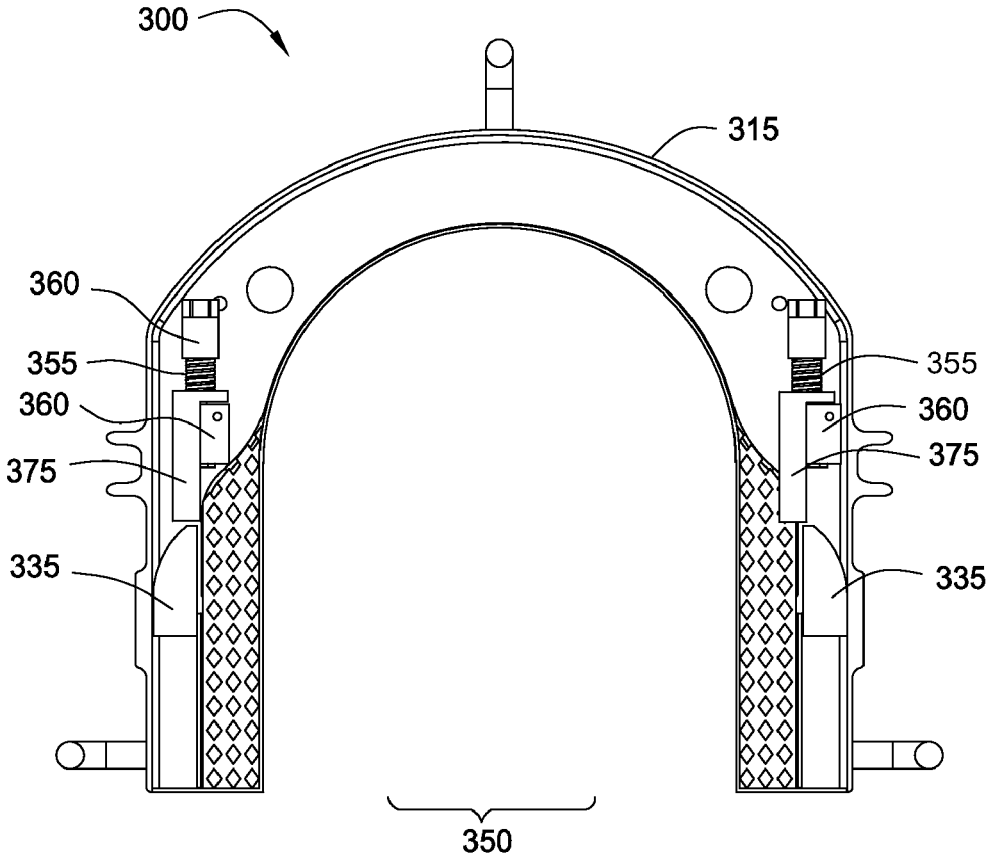
FIG. 19 is a view of an indicator for use with the single joint elevator.

FIG. 19 is a view of an indicator 360 for use with the single joint elevator 300. Generally, the indicator 360 is used to indicate that the single joint elevator 300 is in the closed configuration. The indicator 360 is activated as the wedge block 335 is moved laterally away from the access opening 350 by the cylinder 365 thereby causing a slide member 375 to compress a biasing member 355, such as a spring. The compression of the biasing member 355 activates the indicator 360. In one embodiment, the indicator 360 includes a plunger that is extended (or retracted) when the biasing member 335 is compressed. The configuration of the indicator 360 may be sensed optically, electrically, pneumatically or hydraulically. The indicator 360 may be incorporated as part of a safety interlock system. Such a system may be configured to confirm that a tubular is securely held by the single joint elevator 300 and prevent inadvertent release of the tubular from the single joint elevator 300. The safety interlock system may be further configured to interact with the control systems of other tubular handling equipment in use simultaneously with the single joint elevator 300 (such as top drive, casing running tools, rig floor spider, tongs, etc.) in order to ensure appropriate coordination of the tubular handling operation.

Figure 20:
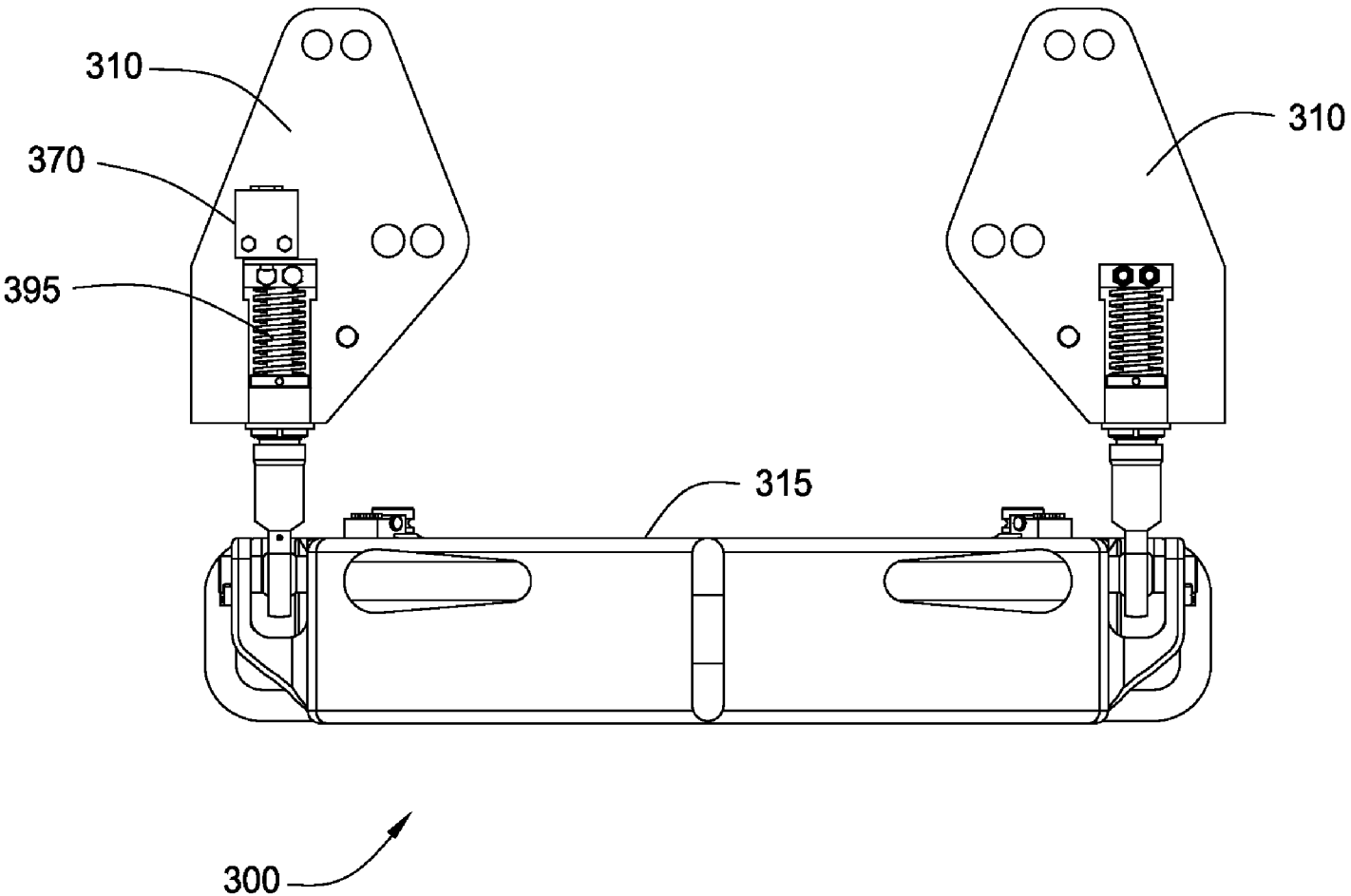
FIG. 20 is a back view of the single joint elevator.

FIG. 20 is a back view of the single joint elevator 300. As illustrated, the single joint elevator 300 includes a lock assembly 370. The lock assembly 370 is configured to de-energize the source that controls the opening and closing functions of the single joint elevator 300, such as the cylinders 365 in this embodiment. The lock assembly 370 is used by a hydraulic system connected to the cylinder 365 to prevent opening of the single joint elevator 300. In operation, the single joint elevator 300 moves from the open configuration to the closed configuration which causes the closure members 325 to close around the tubular (similar to FIG. 3). Thereafter, the running unit is lifted along with the bails which cause the single joint elevator 300 to slide upwards guided by the tubular until the single joint elevator 300 come in contact with the coupling on the tubular. As the tubular is lifted, the weight of the tubular causes a biasing member 305 to elongate. The change in the configuration of the biasing member 395 causes the lock assembly 370 to deactivate the hydraulic system and lock the single joint elevator 300 to prevent inadvertent release of the tubular 90 from the single joint elevator 100. In one embodiment, the lock assembly 370 includes a plunger that is extended (or retracted) when the biasing member 395 elongates. The configuration of the lock assembly 370 may be sensed optically, electrically, pneumatically or hydraulically. The lock assembly 370 may be incorporated as part of a safety interlock system. Such a system may be configured to confirm that a tubular is securely held by the single joint elevator 300 and prevent inadvertent release of the tubular from the single joint elevator 300. The safety interlock system may be further configured to interact with the control systems of other tubular handling equipment in use simultaneously with the single joint elevator 300 (such as top drive, casing running tools, rig floor spider, tongs, etc.) in order to ensure appropriate coordination of the tubular handling operation. Additionally, it should be noted that the other embodiments described herein may use a similar lock assembly to de-energize the source that controls the opening and closing functions of the single joint elevator.

The features and mechanisms (e.g. bail attachments, locking assemblies, guides, control signals etc.) of each embodiment may be interchangeable with the other embodiments described herein, Additionally, while the foregoing is directed to embodiments of the present invention, other and further embodiments of the invention may be devised without departing from the basic scope thereof, and the scope thereof is determined by the claims that follow.

The invention claimed is:

1. A remotely operated single joint elevator for use in handling a tubular, the single joint elevator comprising:

a housing having an access opening configured to receive the tubular;

at least one closure member connected to the housing via a hinge pin, the at least one closure member having a guide slot; and a wedge block configured to rotate the at least one closure member around the hinge pin to selectively open and close the access opening, wherein the wedge block includes a pin member that moves along the guide slot as the wedge block moves relative to the at least one closure member.

2. The single joint elevator of claim 1, further comprising a lock assembly configured to lock the at least one closure member upon indication that the tubular is in the single joint elevator and the access opening is closed.

3. The single joint elevator of claim 2, wherein the lock assembly is configured to send a signal which causes the wedge block to prevent movement of the at least one closure member.

4. The single joint elevator of claim 1, further including a cylinder that is configured to move the wedge block between a first position and a second position relative to the access opening.

5. The single joint elevator of claim 4, wherein the movement of the wedge block between the positions causes the at least one closure member to rotate around the hinge pin.

6. The single joint elevator of claim 4, wherein the wedge block includes a cam surface that interacts with a side portion of the at least one closure member, whereby the movement of the wedge block causes the cam surface to act against the side portion which rotates the at least one closure member around the hinge pin.

7. A method of handling a tubular using a remotely operated single joint elevator, the method comprising:

positioning the single joint elevator proximate the tubular, the single joint elevator having a wedge block and at least one closure member;

selectively exposing an access opening of the single joint elevator by moving the wedge block along an outer surface of the at least one closure member which causes a pin on the wedge block to move along a slot in the at least one closure member;

receiving the tubular in the access opening; and moving the wedge block along the outer surface of the at least one closure member to selectively close the access opening.

8. The method of claim 7, further including sensing the tubular is positioned in the single joint elevator.

9. The method of claim 8, further including locking the single joint elevator such that the access opening remains closed.

10. The method of claim 7, further including selectively exposing the access opening to allow the tubular to be released from the single joint elevator.

11. The method of claim 7, wherein an inner surface of the at least one closure member partially surrounds the tubular when the access opening is closed.

12. A remotely operated single joint elevator for use in handling a tubular, the single joint elevator comprising:

a housing having an access opening configured to receive the tubular;

at least one closure member pivotally attached to the housing, wherein the at least one closure member includes an inner surface that partially surrounds the tubular when the tubular is received within the housing and an outer surface; and a wedge block configured to slide along the outer surface of the at least one closure member to cause the at least one closure member to move between an open position and a closed position, the wedge block having a pin member that moves along a guide slot formed in the at least one closure member as the wedge block slides relative to the at least one closure member.

13. The single joint elevator of claim 12, wherein the wedge block includes a locking surface that mates with a corresponding locking surface on the at least one closure member when the at least one closure member is in the closed position.

* * * * *